US006688153B2

(12) United States Patent
Kanamaru et al.

(10) Patent No.: US 6,688,153 B2
(45) Date of Patent: Feb. 10, 2004

(54) TOOTHED PART WITH A SHAFT AND MOLDING METHOD FOR THE SAME

(75) Inventors: Hisanobu Kanamaru, Sagamihara (JP); Nobuyuki Ishinaga, Sagamihara (JP); Toshio Suzuki, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 09/818,292

(22) Filed: Mar. 27, 2001

(65) Prior Publication Data

US 2001/0025521 A1 Oct. 4, 2001

(30) Foreign Application Priority Data

Mar. 30, 2000 (JP) ..... 2000-093345

(51) Int. Cl.[7] ..... B21K 1/30
(52) U.S. Cl. ..... 72/356; 72/355.4; 74/434
(58) Field of Search ..... 29/893.34; 72/343, 72/348, 352, 354.2, 354.6, 355.2, 355.4, 356; 74/434

(56) References Cited

U.S. PATENT DOCUMENTS 4,314,472 A * 2/1982 Saegusa et al. ..... 72/356
4,739,644 A 4/1988 Maki et al. ..... 72/359
5,732,586 A 3/1998 Muessig et al. ..... 72/267

FOREIGN PATENT DOCUMENTS

| | | | |
|---|---|---|---|
| DE | 197 23 073 | 12/1998 | ..... B21D/22/14 |
| JP | 61-279330 | * 12/1986 | ..... 29/893.34 |
| JP | 1-95822 | * 4/1989 | ..... 72/355.4 |
| JP | 4-9243 | * 1/1992 | ..... 29/893.34 |
| JP | 04 258337 | 9/1992 | ..... B21J/5/08 |

* cited by examiner

*Primary Examiner*—Lowell A. Larson
(74) *Attorney, Agent, or Firm*—Darby & Darby

(57) ABSTRACT

A method for producing a unitary toothed part with a shaft and the resulting products. In the process, a blank is formed. The blank includes a shaft part and a flange part. The flange part having a thicker outer diameter and a thinner inner diameter. The outer diameter is formed into a tubular part by drawing. A plurality of teeth and remnants are formed by extruding the tubular part. At least one spline is formed by extruding the shaft part. Through the steps of forming, drawing, and extruding, a blank is made into a unitary part having teeth and a shaft thus increasing precision, rigidity, durability, and reducing forming costs.

11 Claims, 6 Drawing Sheets

TOOTHED PART WITH A SHAFT AND MOLDING METHOD FOR THE SAME

BACKGROUND TO THE INVENTION

1. Field of the Invention

The present invention relates to a high precision toothed part, or gear, having a shaft and a method of molding the same. Such parts are frequently used within the automatic transmissions of automobiles.

2. Description of the Related Art

In conventional methods for forming this type of gear with a shaft, the shaft part and the flange part are difficult to mold or form as a unit. In a first conventional method, a shaft part and a flange part are molded separately, and then welded together afterwards. The first conventional method requires anti-carburizing and pre-processing for welding. The first conventional method also required a separate jig for holding the parts during welding. Since heat is used during the first conventional method, there are associated heat deformation problems resulting in precision losses and high production costs.

Referring now to FIGS. 6(A) and 6(B), an alternative second conventional method exists for forming this type of gear with a shaft. In the second conventional method, the part and shaft are molded from an initial unitary object. In this method, a raw material 20 is formed in to an intermediate product 21. Raw material 20 is constructed from a disk-shaped flange part 20*a* and a cylindrical shaft part 20*b*. A tubular part 21 a and a bottom part 21*b* are formed by backwards extruding flange part 20*a*. Upon completion of the backwards extrusion intermediate product 21 is completed but requires further complex processing before reaching a final form.

This second conventional method requires very high pressure to achieve the backwards extrusion of flange part 20*a*. Due to the high extrusion pressure, the life span of an extrusion die is short and the cost for construction for the die and other extrusion equipment is high. The high extrusion pressures also requires intermediate product 21 to have an undesirable thick bottom part 21*b* and tubular part 21*a*. The backwards extrusion method has poor net shape rate result and production losses are high. Finally, this molding method is difficult to apply to large parts.

OBJECT AND SUMMARY OF THE INVENTION

It is an object of the present invention to provide a high precision method of molding.

It is another object of the present invention to provide a method of molding a toothed part with shaft that has high precision.

It is another object of the present invention to provide a toothed part with shaft that has high precision, high rigidity, and strength.

It is another object of the present invention to provide a method of molding a toothed part with hollow shaft and a flange constructed from a bottom part.

It is another object of the present invention to provide a method of molding a tubular part, or a flange constructed from a tubular part, and disk part.

It is another object of the present invention to provide a method of molding teeth on a tubular part or on a shaft.

It is another object of the present invention to provide a combination of plastic working steps in a method for producing a final product with precise dimensions and low loss rates.

It is to be understood that the word plastic, or plastic working applies to the material being malleable or deformable during a working process and does not require a carbon material, or any other specific material, to be used with the method.

Briefly stated the present invention relates to a method for producing a unitary toothed part and a shaft and the resulting products. In the process, a blank is formed. The blank includes a shaft part and a flange part. The flange part having a thicker outer diameter and a thinner inner diameter. The outer diameter is formed into a tubular part by drawing. A plurality of teeth and remnants are formed by extruding the tubular part. At least one spline is formed by extruding the shaft part. Through the steps of forming, drawing, and extruding a blank is made into a unitary part having teeth and a shaft thus increasing precision, rigidity, durability, and reducing forming costs.

According to an embodiment of the invention, there is provided a method for molding a toothed part with a shaft comprising the steps of: forming a raw material blank, the raw material blank includes at least a flange part and a shaft part coaxial and perpendicular to the flange part, drawing a tubular part, the tubular part on a first part of the flange part, parallel to and away from the shaft, extruding a plurality of teeth portions, the teeth portions on the tubular part disposed on an outer surface of the tubular part away from the shaft part, and extruding at least a first spline, said spline on the shaft part.

According to another embodiment of the present invention, there is provided a method for molding a toothed part with a shaft, further comprising the steps of: forming the flange part into a large diameter part and a small diameter part, the large diameter part being the first part and larger than and concentric to the small diameter part, and the large diameter part being thicker than the small diameter part, and forming a plurality of remnant parts by extrusion, the remnant parts between the tubular part and the shaft part interposed with the plurality of teeth.

According to another embodiment of the present invention, there is provided a method for molding a toothed part with a shaft comprising the steps of: forming a raw material blank, the raw material blank includes at least a flange part and a shaft part coaxial and perpendicular to the flange part, drawing a tubular part, the tubular part on a first part of the flange part, parallel to and toward the shaft, extruding a plurality of teeth portions, the teeth portions on the tubular part disposed on an outer surface of the tubular part toward the shaft part, and extruding at least a first spline, the at least first spline on the shaft part.

According to another embodiment of the present invention, there is provided a method for molding a toothed part with a shaft, further comprising the steps of: forming the flange part into a large diameter part and a small diameter part, the large diameter part being the first part and larger than and concentric to the small diameter part, and the large diameter part being thicker than the small diameter part, and forming a plurality of remnant parts by extrusion, the remnant parts between the tubular part and the shaft part interposed with the plurality of teeth.

According to another embodiment of the present invention, there is provided a toothed element, comprising: a shaft part and a tubular part extend coaxial along a central axis, the tubular part extends in a first direction along the central axis, a bottom part extends perpendicular to the axis between the shaft part and the tubular part, the tubular part has a first outer surface opposite to the central axis, the shaft part has a second outer surface opposite to the central axis, a plurality of teeth on the first outer surface, a plurality of extrusion remnants interposed between the teeth on the first outer surface, and at least a first spline on the second outer surface.

According to another embodiment of the present invention there is provided a toothed element, wherein: the first direction is parallel to and away from the shaft part.

According to another embodiment of the present invention there is provided a toothed element, wherein: the first direction is parallel and concentric to the shaft part.

According to another embodiment of the present invention there is provided a method of molding a toothed part with a shaft, comprising the steps of: forming a flange part and a shaft part having a common center axis, drawing the flange part into a tubular part and a bottom part, and extruding the tubular part to form a plurality of teeth.

According to another embodiment of the present invention there is provided a method of molding a toothed part with a shaft, wherein: forming a flange part and a shaft part is conducted by cold forging.

According to another embodiment of the present invention there is provided a method of molding a toothed part with a shaft, wherein: the flange part includes a large diameter part and a small diameter part, the large diameter part having a thickness greater than a thickness of the small diameter part.

The above, and other objects, features and advantages of the present invention will become apparent from the following description read in conjunction with the accompanying drawings, in which like reference numerals designate similar elements.

DESCRIPTION OF THE PREFERRED EMBODIMENTS

Figure 1A:
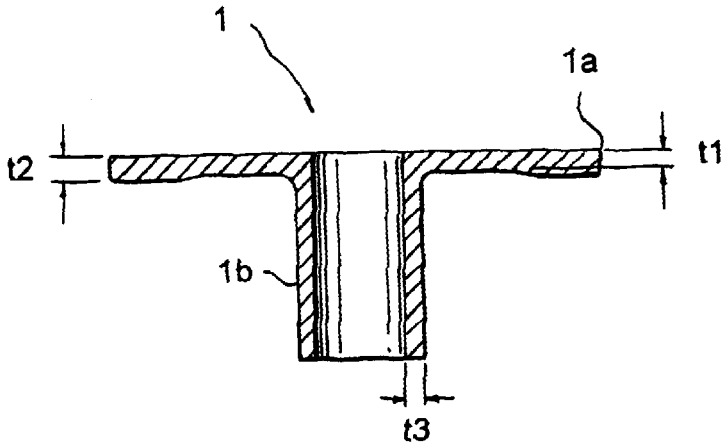
FIG. 1(A) is a figure of a raw material shape.
Figure 1B:
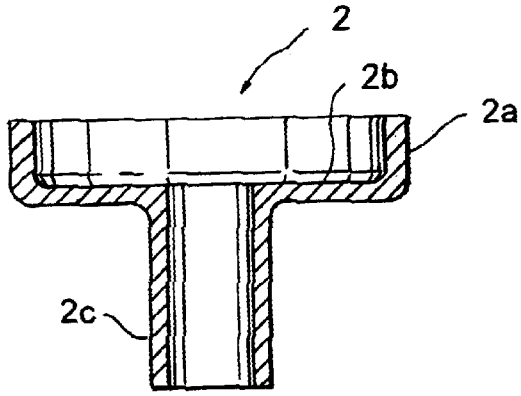
FIG. 1(B) is a figure of an intermediate product.

Referring now to FIGS. 1(A) and 1(B), a malleable raw material 1 includes a disk-shaped flange part 1*a*, and a tubular shaft part 1*b*. Flange part 1*a* has a large diameter part having a thickness t2, and a small diameter part having a thickness t1. Tubular shaft part 1*b* has a thickness t3. It is to be understood that thickness t2 is larger than thickness t1 part. Thickness t2 of the large diameter part is larger than thickness t1 of the small diameter part. It is to be understood, that while raw material 1 is the precursor to later formed intermediate part 2, the size, shape, and thickness of flange part 1*a* and shaft part 1*b* are selected to allow easy formation of the later formed intermediate product 2.

It is to be understood that raw material 1 may be formed by many forming methods common in the field, but that cold forging is a commonly used and economic method since heat forging acts to abrade the forming mold and reduce precision.

In manufacture, according to the first embodiment, by drawing flange part 1*a*, raw material 1 becomes intermediate product 2. Intermediate product 2 includes a tubular shaft part 2*c* and a flange. The flange includes a tubular part 2*a* and a bottom part 2*b*. During forming, the large diameter part of flange part 1*a* is molded thicker than the small diameter part. Raw material 1 is designed so that, in addition to having a thin bottom part 2*b*, the material of intermediate part 2 flows easily, and with lower loads. The proper formation of raw material 1, with the specified and shaped flange part 1*a*, allows the desired thickness of tubular part 2*a* to be easily obtained with less load.

It is to be understood, that small diameter thickness t1 and large diameter thickness t2 are selectable according to the desired final product, the loads acting upon a forming die, need for additional material to form intermediate products with differing outer dimensions, or other factors. Since thickness t1, t2, and t3 are selectable, according to intermediate and final needs, a wide variety of final products are achievable using this method.

Figure 1C:
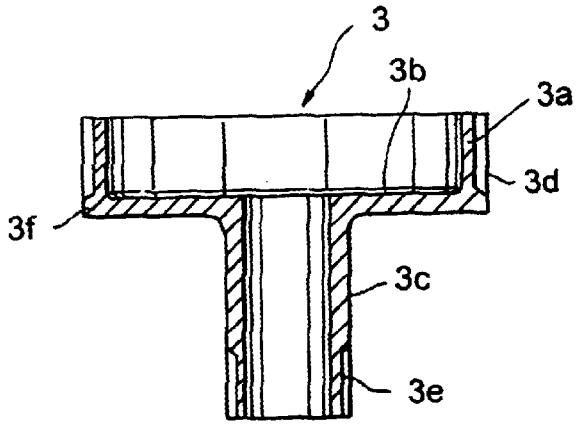
FIG. 1(C) is a figure of a molded product.
Figure 2:
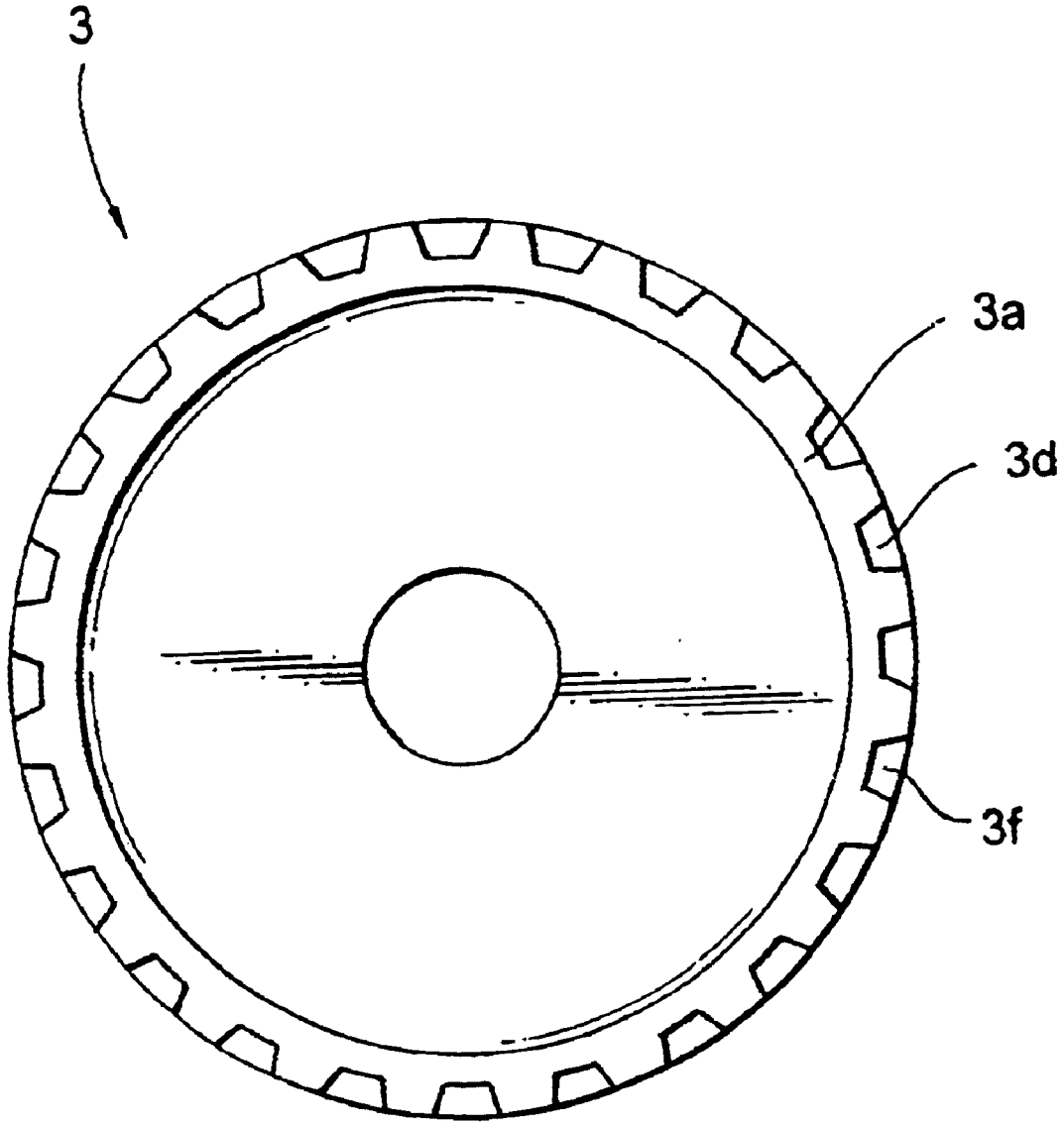
FIG. 2 is a top view of a molded product.
Figure 3:
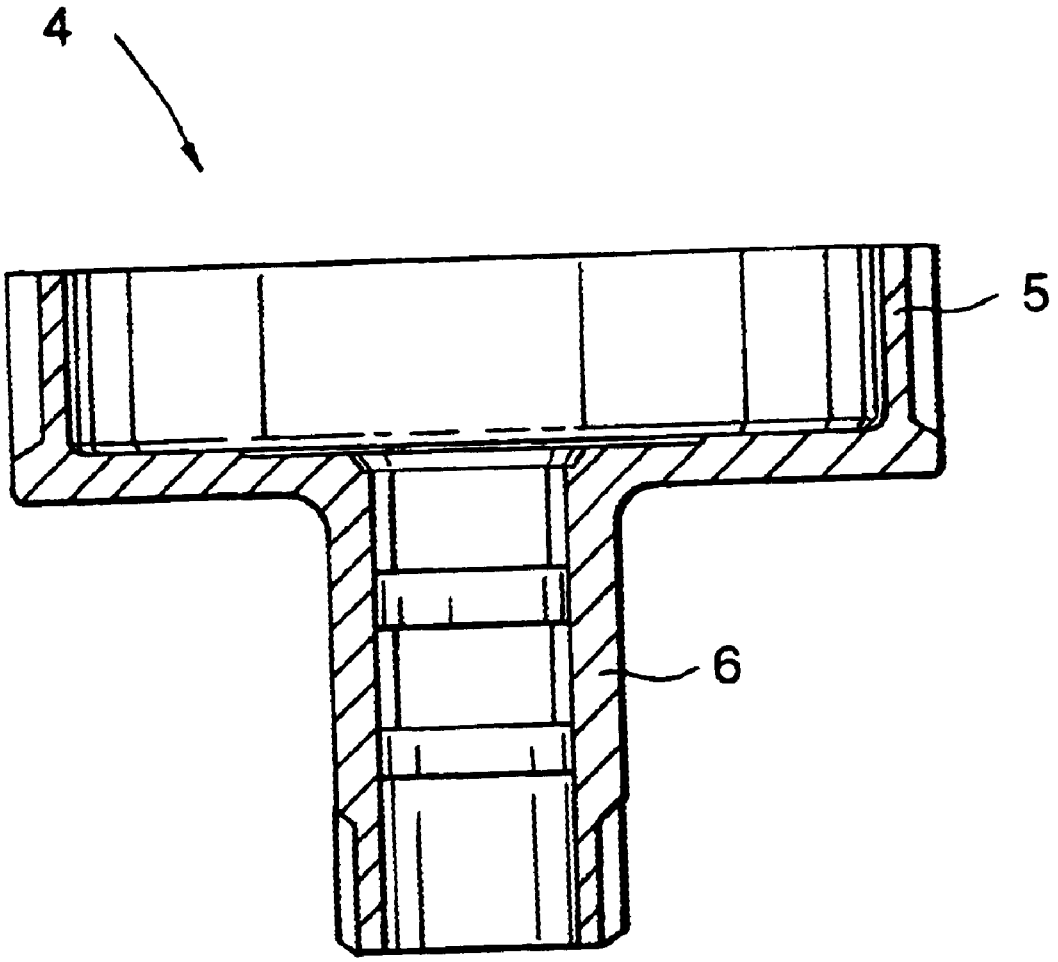
FIG. 3 is a interior view of a final product.
Figure 4A:
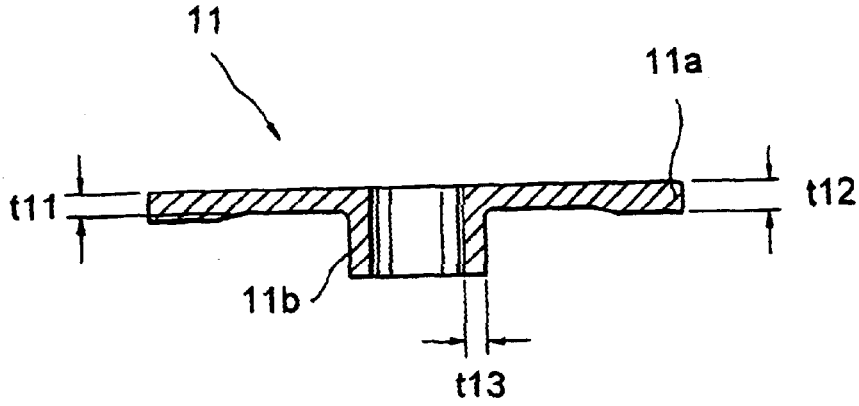
FIG. 4(A) is a figure of a raw material shape.
Figure 4B:
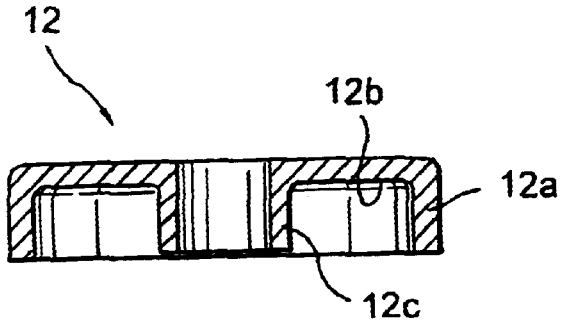
FIG. 4(B) is a figure of an intermediate product.
Figure 4C:
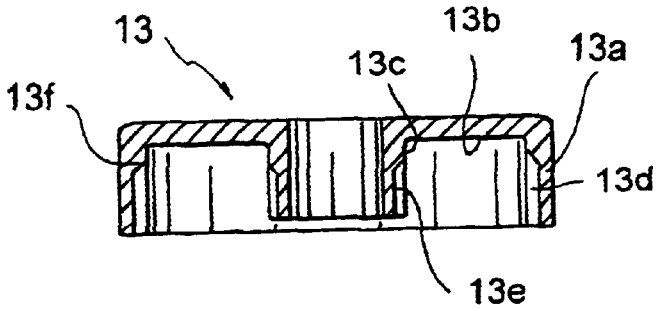
FIG. 4(C) is a figure of a molded product.
Figure 5:
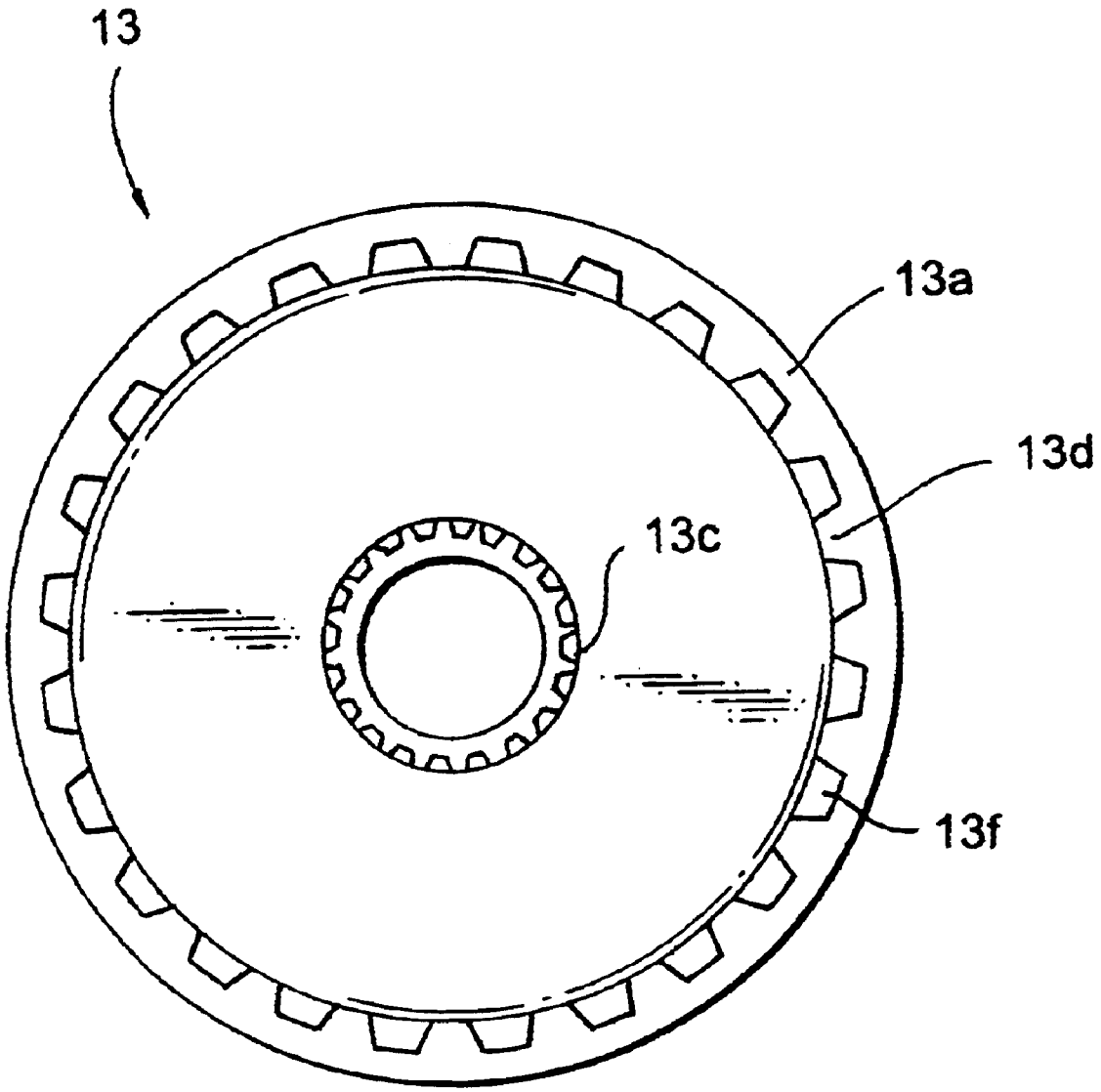
FIG. 5 is a bottom view of a molded product.
Figure 6A:
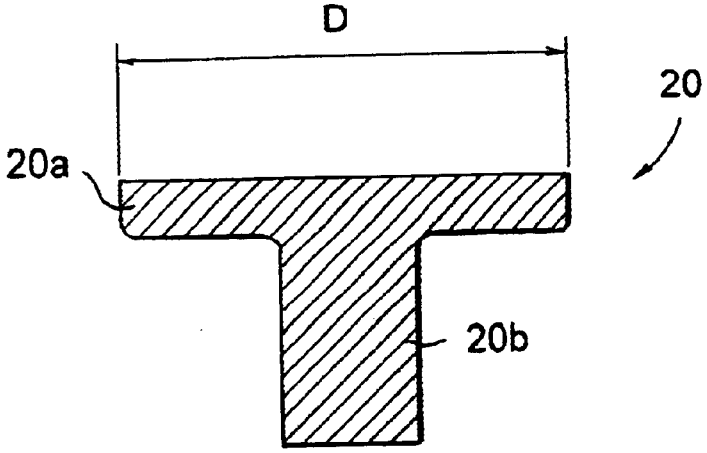
Fig. 6(A) (Prior Art)
FIG. 6(A) is a process diagram of the prior art.
Figure 6B:
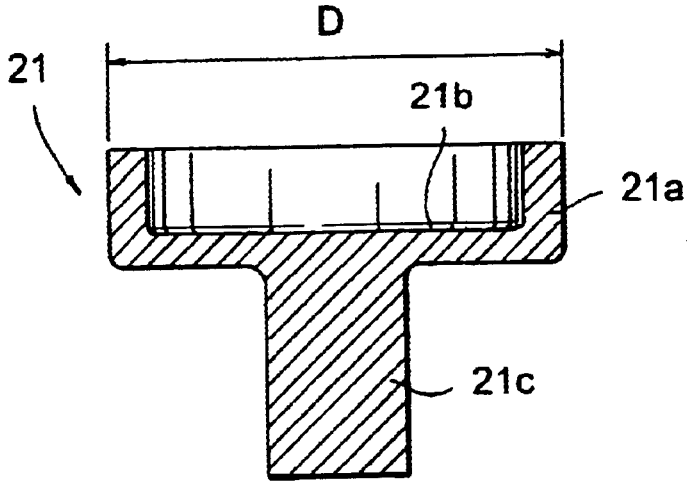
Fig. 6(B) (Prior Art)
FIG. 6(B) is a process diagram of the prior art.

Referring additionally to FIGS. 1(C), 2, and 3, intermediate product 2 is molded in a desired manner and becomes a molded product 3. Molded product 3 includes a shaft part 3*c* extending away from a flange including a bottom part 3*b* and a tubular part 3*a*. Teeth 3*d*, formed from tubular part 2*a*, are molded along the outer portion of tubular part 3*a* and bottom part 3*b*. Teeth 3*d* are formable in a shape, pitch, and frequency according to a manufacturer or customer need.

An extrusion remnant 3*f* is formed through the extrusion process near bottom part 3*b* and acts to improve the rigidity and strength of teeth 3*d*. A spline 3*e* is formed on shaft 2*c*, during molding on shaft part 3*a* for use in later assembly.

After molded product 3 is formed, through cutting, punching a hole for lubrication oil, or any other manufacturer determined step, molded product 3 becomes the final component shown in FIG. 3. Through assembly with bushings 6, or other manufacturer desired items, molded product 3 becomes an assembled product 4 with teeth parts 5.

Referring additionally now to FIGS. 4(A), 4(B), 4(C), and 5, a second embodiment of the present invention is shown for a molding process to form a toothed part with a shaft. Raw material 11 is constructed from a disk-shaped flange part 11 a and a tubular shaft part 11*b* extending away from flange part 11*a*. Flange part 11*a* is formed to include a large diameter part, having a thickness t12 and a small diameter part having a thickness t11. Thickness t11 is less than thickness t12. Shaft part 1*b* has a thickness t13.

During formation by drawing flange part 11*a*, raw material 11 becomes intermediate product 12. Intermediate product 12 is includes a tubular shaft part extending away from a flange. The flange is constructed from a tubular part 12*a* parallel to shaft part 12*c*, and a disk part 12*b*, generally perpendicular to shaft part 12*c*.

As described above, the large diameter part of flange part 11*a* is thicker than the small diameter part of flange part 11*a*. It is to be understood, that the thickness of the large and small diameter parts is selected to provide for a thin disk part 12*b*, the needs of a final product, the loads acting upon a forming die, need to for additional material for later construction, and other factors. The thickness is further selected to allow the material to flow in molding more easily, with smaller loads, and still obtain the desired thickness of tubular part 12*a*. Since thickness t11, t12, and t13 are selectable, according to intermediate and final needs, a wide variety of final products are achievable using this method.

In other words the load acting on the die is smaller and various intermediate products with differing outer diameters for tubular part 12*a* can be obtained from the same raw material 11.

Molded product 13 is formed by forming teeth on tubular part 12*a* and by forming a spline on shaft part 12*c*. Molded product 13 includes a shaft part 13*c* and a flange comprising a disk part 13*b* and a tubular part 13*a*.

Teeth 13*d* are in the inner perimeter part of tubular part 13*a*, opposite spline 13*e* and shaft part 13*c*. Teeth 13*d* are formed by extruding tubular part 12*a*. An extrusion remnant part 13*f* is present near disk part 13*b* opposite shaft part 13*c*. Extrusion remnant part 13*f* improves the rigidity and strength of teeth 13*d*. Afterwards, through cutting or through punching holes for lubrication oil, molded product 13 becomes the completed component.

In another embodiment of the present invention formation by cold forging allows a manufacturer to form raw material 11 with precision. If raw material 11 were formed with heat forging, the forming die would abrade, precision would be limited, and die life would decrease.

It is to be understood, that according to either embodiment of the present invention, a high precision toothed part with a shaft may be formed from a unitary body with high precision, without welding.

It is to be understood, that according to either embodiment concerning the method of forming a toothed part with a shaft, the resulting toothed part with a shaft is an additional third and fourth embodiment with either the tubular part facing away from the shaft or forming a cylinder about the shaft.

It is to be further understood, that by devising the thickness for the flange parts of the raw material and by forming the flange of the intermediate product by drawing, the load acting on the die is minimized.

It is to be further understood, that since the load acting on the die is small the life span of the die is correspondingly increased.

It is to be further understood, that using the embodiments of the present invention, a manufacturer may achieve improved near net shape rates, high rigidity and durability, and minimize production costs.

It is to be further understood, that by forming teeth and a remnant part, according to above embodiments, the strength and rigidity of the gear is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for molding a toothed part with a shaft, comprising the steps of:

forming a raw material blank, said blank including at least a shaft part and a flange part, said flange part coaxial and perpendicular to said shaft part;

drawing a tubular part on said flange part parallel to and away from said shaft;

extruding a plurality of teeth portions on a surface of said tubular part;

extruding at least a first spline on the outer surface of said shaft part; and maintaining the inner surface of said shaft part free of splines.

2. A method for molding a toothed part with a shaft, according to claim 1, further comprising the steps of:

forming said flange part into a large diameter part and a small diameter part, said large diameter part being a first portion and larger than and concentric to said small diameter part, and said large diameter part being thicker than said small diameter part; and forming a plurality of remnant parts by extrusion, said remnant parts interposed with said plurality of teeth and between said tubular part and said shaft part.

3. A method for forming a metal part comprising:

forming a blank of metal to form a shaft portion and a flange portion;

said flange portion being a disk generally perpendicular to an axis of said shaft portion;

said disk having an outer annular portion that is thicker than a remainder of said disk;

drawing said outer annular portion into a tubular portion generally parallel to said shaft portion;

forming teeth on one of an inner and an outer surface of said tubular portion, whereby the greater thickness of said tubular portion permits formation of said teeth while retaining substantial strength;

forming at least a first spline on the outer surface of said shaft portion; and maintaining the inner surface of said shaft portion free of splines.

4. A toothed part with a shaft, comprising:

a shaft part and a tubular part coaxial along a central axis;

said tubular part extends in a first direction along said central axis;

a bottom part perpendicular to said axis, between said shaft part and said tubular part;

said tubular part has a first outer surface opposite to said central axis;

said shaft part has a second outer surface opposite to said central axis;

said shaft part has a first inner surface facing said central axis;

a plurality of teeth on said first outer surface;

a plurality of extrusion remnants interposed between said teeth on said first outer surface; and at least a first spline on said second outer surface;

said first inner surface being free of splines.

5. A toothed element, according to claim 4, wherein:

said first direction is parallel to and away from said shaft part.

6. A toothed element, according to claim 4, wherein:

said first direction is parallel and concentric to said shaft part.

7. A method of molding a toothed part with a shaft, comprising the steps of:

forming a flange part and a shaft part having a common center axis, said flange part coaxial and perpendicular to said shaft part;

drawing said flange part into a tubular part and a bottom part;

extruding said tubular part to form a plurality of teeth;

extruding at least a first spline on the outer surface of said shaft part; and maintaining the inner surface of said shaft part free of splines.

8. A method of molding a toothed part with a shaft, according to claim 7, wherein:

said flange part includes a large diameter part and a small diameter part; and said large diameter part having a thickness greater than a thickness of said small diameter part.

9. A method of molding a toothed part with a shaft, according to claim 8, wherein: said forming a flange part and a shaft part is conducted by cold forging.

10. A method for molding a toothed part with a shaft, comprising the steps of:

forming a raw material blank comprising at least a shaft part and a flange part, said flange part coaxial and perpendicular to said shaft part;

drawing a tubular part on said flange part parallel to and away from said shaft;

extruding a plurality of teeth portions on a surface of said tubular part;

whereby said teeth portions are rigid; and extruding at least a first spline on said shaft part.

11. A toothed part with a shaft, comprising:

a shaft part and a tubular part coaxial along a central axis;

said tubular part extends in a first direction along said central axis;

a bottom part perpendicular to said axis, between said shaft part and said tubular part;

said tubular part has a first outer surface opposite to said central axis;

said shaft part has a second outer surface opposite to said central axis;

said shaft part has a first inner surface facing said central axis;

a plurality of teeth on said first outer surface;

a plurality of extrusion remnants near said bottom part and interposed between said teeth on said first outer surface; and at least a first spline on said second outer surface;

said first inner surface being free of splines.

* * * * *